US005108557A

United States Patent [19]

Nordquist

[11] Patent Number: 5,108,557

[45] Date of Patent: Apr. 28, 1992

[54] ORE POINT FEEDER AND METHOD FOR SODERBERG ALUMINUM REDUCTION CELLS

[75] Inventor: James H. Nordquist, The Dalles, Oreg.

[73] Assignee: Northwest Aluminum Company, The Dalles, Oreg.

[21] Appl. No.: 592,821

[22] Filed: Oct. 4, 1990

[51] Int. Cl.[5] ..... C25C 3/06; C25C 3/14; C25C 3/22

[52] U.S. Cl. ..... 204/67; 204/245; 204/247

[58] Field of Search ..... 204/67, 243 R-247

[56] References Cited

U.S. PATENT DOCUMENTS

| | | | |
|---|---|---|---|
| 3,192,140 | 6/1965 | Zorzenoni | 204/247 X |
| 3,551,308 | 12/1970 | Capitaine et al. | 204/246 X |
| 3,673,075 | 6/1972 | Kibby | 204/247 X |
| 4,002,551 | 1/1977 | Duclaux et al. | 204/245 X |
| 4,302,302 | 11/1981 | Kaifuchi | 204/67 |
| 4,437,964 | 3/1984 | Gerphagnon et al. | 204/245 |
| 4,525,105 | 6/1985 | Jaggi | 204/245 X |

FOREIGN PATENT DOCUMENTS

| | | | |
|---|---|---|---|
| 254107 | 3/1970 | U.S.S.R. | 204/245 |
| 326247 | 2/1972 | U.S.S.R. | 204/245 |
| 899723 | 1/1982 | U.S.S.R. | 204/245 |

*Primary Examiner*—Donald R. Valentine
*Attorney, Agent, or Firm*—Marger, Johnson, McCollom & Stolowitz

[57] ABSTRACT

Improved methods and apparatus for carrying out the methods are disclosed for feeding alumina into a Soderberg type aluminum reduction cell (10), so as to maximize efficiency of the cell. The apparatus includes a continuous point feeder assembly (12) connected to the cell structure over an exposed peripheral portion of the cryolite bath. The feeder assembly includes as alumina feed hopper (40) and a pair of vertically disposed feeding bins (56). Each feeding bin receives alumina from the hopper. A piston and cylinder assembly (46) is connected to the feeder assembly and arranged to drive a crust breaking member (44) down through bath crust (17) to form a temporary opening. The crust breaking member includes discharge port covers (62) which cover the lower ends of the feeding bins when the crust breaking member is retracted, and uncover the lower ends when the crust breaking member is extended, thereby opening feed discharge ports (60) and allowing a predetermined quantity of alumina to flow through the opening and into the bath. The point feeder assembly is actuated at predetermined, frequent intervals and the hopper refilled as necessary. Occasionally, the peripheral curst is broken by an elongate horizontal breaker bar (34) and a supplemental charge of alumina is forced into the bath to achieve maximum concentration.

24 Claims, 5 Drawing Sheets

ORE POINT FEEDER AND METHOD FOR SODERBERG ALUMINUM REDUCTION CELLS

BACKGROUND OF THE INVENTION

1. Field of the Invention

This invention relates to introducing alumina into an aluminum reduction cell, and more particularly, to methods and apparatus for feeding alumina to a Soderberg-type aluminum reduction cell.

The production of aluminum by electrolysis of an aluminum oxide containing material is a well-known process. Commercial production of aluminum is carried out in a reduction cell by the Hall-Heroult process in which alumina is dissolved in molten cryolite (NaF/-NaAlF4) at about 970° C. The aluminum ion is then electrolytically reduced by an electrical current which is passed through the electrolyte. The resulting purified aluminum is collected as a molten metal in a pool beneath the molten electrolyte bath, and periodically removed by a vacuum tap.

Electrical current enters the cell through an anode in contact with the upper surface of the electrolyte bath, passes downward through the electrolyte bath, through the pool of molten aluminum and into a cathode which is integral with the bottom portion of the cell. The current leaves the cell through the cathode and is conducted to the anode of the next in a series of cells which make up a pot line.

The operating temperature of the bath is maintained by resistance heating of the bath, reactions in the cell, and insulating the cell structure.

One well-known reduction cell for carrying out this process is the self-baking anode cell, known as the Soderberg cell. In the Soderberg cell, the anode is continuously formed in place over the rectangular molten electrolyte bath by the baking action of heat from the bath on a carbon paste contained within a hollow steel jacket. Attached to the bottom edge of the anode jacket is a gas collection skirt to contain and exhaust gases produced in the process. As the lower "working surface" of the anode is consumed, the anode is lowered to maintain the desired anode-to-cathode distance, and more carbon paste is added to the top of the anode. As the carbon paste travels slowly downward through the jacket toward the molten bath, it is consolidated by heat and pressure into a compacted anode.

The anode is centered over the molten electrolyte bath for optimal current distribution through the bath. At each end of the cell are electrical connections between the cell and the electrical current distribution system. Along each side edge of the cell, a peripheral region of the molten electrolyte bath extends beyond the anode. Alumina feed material is fed into this peripheral region of the molten electrolyte bath.

Cooling of the surface of the exposed peripheral region of the molten electrolyte bath causes a frozen crust to form which extends from the gas collection skirt to the edge of the bath. If undisturbed, this peripheral region of the bath will freeze solid. Since it is through this region of the bath that alumina is fed to the cell, the electrolyte in this region must remain molten to receive the feed. This is achieved by periodically breaking through the solid crust with a mobile crust breaker, or a powered crust breaker apparatus fitted to the cell structure. The broken crust collapses into the molten pool and remelts leaving an opening in the crust. Alumina is then fed through the opening into the molten bath, and a solid frozen crust subsequently reforms over the edge of the bath.

Economical production of aluminum by electrolytic reduction requires efficient utilization of electrical energy. Numerous factors affect the electrical efficiency of a reduction cell, including current distribution in the molten electrolyte bath, resistance losses in the bath and associated electrical equipment, anode-to-cathode distance within the cell, the amount of aluminum oxide dissolved in the molten electrolyte, the presence of undissolved alumina in the cell, heat losses from the cell, electrolyte temperature, and others. Previous efforts to improve the electrical efficiency of the Soderberg cell have addressed these areas.

To optimize current distribution in the molten electrolyte, and to minimize the electrical resistance of the anode, the width of the anode relative to the molten bath was maximized. With the increased anode width, however, the width of the exposed peripheral region was reduced to the minimum required to allow feeding of alumina to the bath.

In order to minimize the electrical resistance losses in the molten electrolyte, the bath depth was reduced, thereby reducing the anode-to-cathode distance. In a modern Soderberg cell, the electrolyte bath depth is the minimum required for electrolyte bath stability. In order to maintain the desired bath temperature in light of attendant reduced resistance heating of the bath, insulation was added to the bottom of the cell.

The electrical resistance of the electrolyte bath is also affected by the amount of dissolved alumina in the bath. A deficiency of dissolved alumina increases the electrical resistance of the electrolyte, and decreases cell efficiency. The onset of this so called "anode effect" signals cell operators to add a batch of alumina feed to the cell.

The amount of alumina which can be fed to the cell in one batch is limited to the amount that will readily dissolve in the molten electrolyte bath. Excess alumina fed to the cell remains undissolved and may settle on the cathode, increasing the resistance of the cell and reducing the cell's efficiency (sick cell condition).

The operation of a Soderberg cell can therefore be characterized as a series of cycles of alumina saturation and depletion in the molten electrolyte, accompanied by attendant cycles of increasing and decreasing cell efficiency. Efforts to level these cycles by maintaining a more constant alumina concentration in the electrolyte have not been successful with the Soderberg cell. The electrical efficiency of a modern Soderberg cell, with the foregoing features and limitations, typically ranges from 85–88%.

The potential for a competitive advantage from increased electrical efficiency, and the limitations of the Soderberg cell, have led to an improved reduction cell design known as the pre-baked anode cell. The pre-baked anode cell design allows feeding of alumina into the center portion of the bath. Two advantages flow from center alumina feed. First, alumina fed to the center of the bath dissolves and disperses throughout the working area of the bath more quickly, minimizing the potential for undissolved alumina to accumulate in the cell. Secondly, there is no frozen crust in the center of the bath which must be broken prior to feeding. This feature allows alumina to be fed frequently in small amounts, referred to as continuous feeding, without disrupting the heat balance of the cell. By providing a more constant dissolved alumina concentration in the molten electrolyte, the alumina saturation and depletion cycles inherent in the Soderberg cell design are largely eliminated. The electrical efficiency of the pre-baked anode cell is increased to 92-96%. This represents a significant efficiency gain, and provides a competitive advantage for aluminum producers who employ pre-baked anode reduction cells.

In light of the competitive nature of the primary aluminum industry, continually increasing costs of electrical energy, and the significant efficiency advantage of the pre-baked anode cell, aluminum producers using Soderberg cells are forced to choose between an enormous capital investment to replace their Soderberg cells with pre-baked anode cells, or continued operation with their existing cells at a competitive disadvantage. What is needed, therefore, is a way to improve the efficiency of existing Soderberg cells in order to make them more competitive with pre-baked anode cells.

2. Description of Related Art

U.S. Pat. No. 4,016,053 to Stankovich et al discloses a feed distribution system for use in aluminum production plants. The '053 invention distributes alumina from a central storage bin to the vicinity of reduction cells (pre-baked or Soderberg type) throughout a plant by means of air fluidized conveyors. The '053 patent does not disclose a way to improve the efficiency of a Soderberg cell.

U.S. Pat. No. 3,888,747 to Murphy discloses a system for sensing the onset of an anode effect in a reduction cell by detecting an increase in the cell voltage, and for responding by producing an output signal. The system may include devices for detecting the output signal and feeding alumina to the bath in response to the signal. The '747 patent teaches routinely feeding alumina to the cell in an amount less than that required to prevent the onset of anode effects, then, at the onset of an anode effect, feeding an additional amount of alumina to the cell. In each instance, alumina is fed to the cell by storing a batch of alumina on top of the solid crust covering the edge of the bath, then breaking the solid crust and forcing the crust and alumina into the bath.

U.S. Pat. No. 4,431,491 to Bonney et al teaches a process and apparatus for correlating measured cell resistance values with the required amount of alumina feed for controlling the dissolved alumina content in the electrolyte, and for introducing the required amount of feed into the bath through a continuously open portion of the bath. The peripheral portion of the bath in a modern Soderberg cell cannot be kept continuously open, however, because unacceptable heat loss and operating conditions would ensue.

U.S. Pat. No. 4,035,251 to Shiver et al discloses a method of operating an alumina reduction cell by monitoring the cell resistance changes, and regulating the addition of alumina to the cell responsive to the cell resistance changes. As applied to the Soderberg cell, the method is used to trigger a typical batch feeding step where alumina is fed into the peripheral portion of the bath after breaking the solid crust.

It is against this background that the present invention was developed.

SUMMARY OF THE INVENTION

One aspect of the invention is a continuous point feeder assembly for introducing alumina into a Soderberg-type aluminum reduction cell. The point feeder is arranged to be connected to the cell structure. It includes a feed hopper for storing alumina and a point breaker for forming an opening in the frozen crust covering the molten electrolyte bath in the cell, so that alumina can flow from the hopper, through the opening and into the molten electrolyte bath.

The point breaker apparatus includes a rigid, elongated, crust breaking member connected to a pneumatic cylinder and piston assembly for moving the crust-breaking member downward and for driving a lower end of the crust breaking member through the frozen crust, and then retracting the crust-breaking member to the retracted position.

The means for feeding the alumina into the bath includes a rigid, hollow, elongate feeding bin for receiving alumina from the feed hopper. The feeding bin includes an upper portion fixed to the feed hopper. The upper portion has a closed sidewall that includes an aperture defining a feeding bin inlet port which communicates with the interior of the hopper for receiving alumina. The feeding bin also includes a lower portion extending below the feed hopper and having a closed sidewall so that the lower portion, in use, fills with alumina received through the inlet port.

The lower portion terminates in an open bottom end defining a discharge port, through which the alumina flows by gravity into the bath when the discharge port is open. However, a discharge port cover is fixed to the crust-breaking member, and disposed so that, when the crust-breaking member is in the retracted position, the port cover sealingly engages the periphery of the feed discharge port to cover the port, thereby preventing the flow of alumina from the feeder bin.

When the crust-breaking member driving means, i.e. the piston and cylinder assembly, is operated to drive the lower end portion of the crust breaking member downward through the frozen crust covering the molten electrolyte bath, the port cover is disengaged from the periphery of the feeder discharge port to uncover the port, thereby allowing alumina to flow through the opening in the frozen crust, and into the molten electrolyte bath. This arrangement has the advantages of controlling both crust breaking and ore feeding operations by a single piston assembly.

An air slide conveyor is disposed along the inside floor of the hopper and inclined to transfer alumina to a location adjacent the feeder bin inlet port for filling the feeder bin.

In accordance with the invention, existing Soderberg cells can be retrofitted with such a point feeder assembly. A retrofitted cell thus would have both a point feeder assembly for continuously feeding a primary amount of alumina into the molten bath; and conventional means for intermittently feeding a supplementary batch of alumina into the molten bath along the periphery. In most cases, retrofitting a cell includes the steps of forming a recess in the gas collection skirt for receiving the crust breaking member; positioning the continuous point feeder assembly over the recess so that a portion of the crust breaking member is disposed within the recess; and removably securing the continuous point feeder assembly to the anode jacket. In some applications, it is convenient to remove the point feeder assembly to refill the hopper with alumina. Slots are provided to receive lift truck tines for that purpose. In other applications, the hopper lid is raised and fresh alumina deposited into the hopper in place on the cell.

The new method of feeding alumina into a Vertical stud Soderberg type reduction cell includes continuously forming an opening in a portion of the solid frozen crust; continuously feeding a primary amount of alumina into the molten electrolyte bath through the opening; intermittently breaking substantially the entire solid frozen crust, and driving the crust into the molten bath peripheral side region; and feeding a batch of supplemental alumina into the peripheral side region before the surface thereof refreezes.

The point feeder assembly operates continuously. Here, "continuously" is not taken literally. Rather, it means that at frequent, predetermined intervals, a controller activates the point feeder pneumatic assembly to drive the point crust breaker through the crust and discharge alumina into the cell from the feeder bins. The frequency and volume of this continuous feeding is arranged to provide alumina at a rate slightly less than the rate at which the alumina is converted into aluminum. As a result, the concentration of dissolved alumina in the bath eventually falls low enough to begin the onset of anode effect. At that time, a supplemental batch of alumina is fed into the cell using the horizontal breaker bar. This method of operation has been found to yield a significant improvement in cell efficiency.

The foregoing and other objects, features and advantages of the invention will become more readily apparent from the following detailed description of a preferred embodiment which proceeds with reference to the drawings.

DESCRIPTION OF A PREFERRED EMBODIMENT

Figure 1:
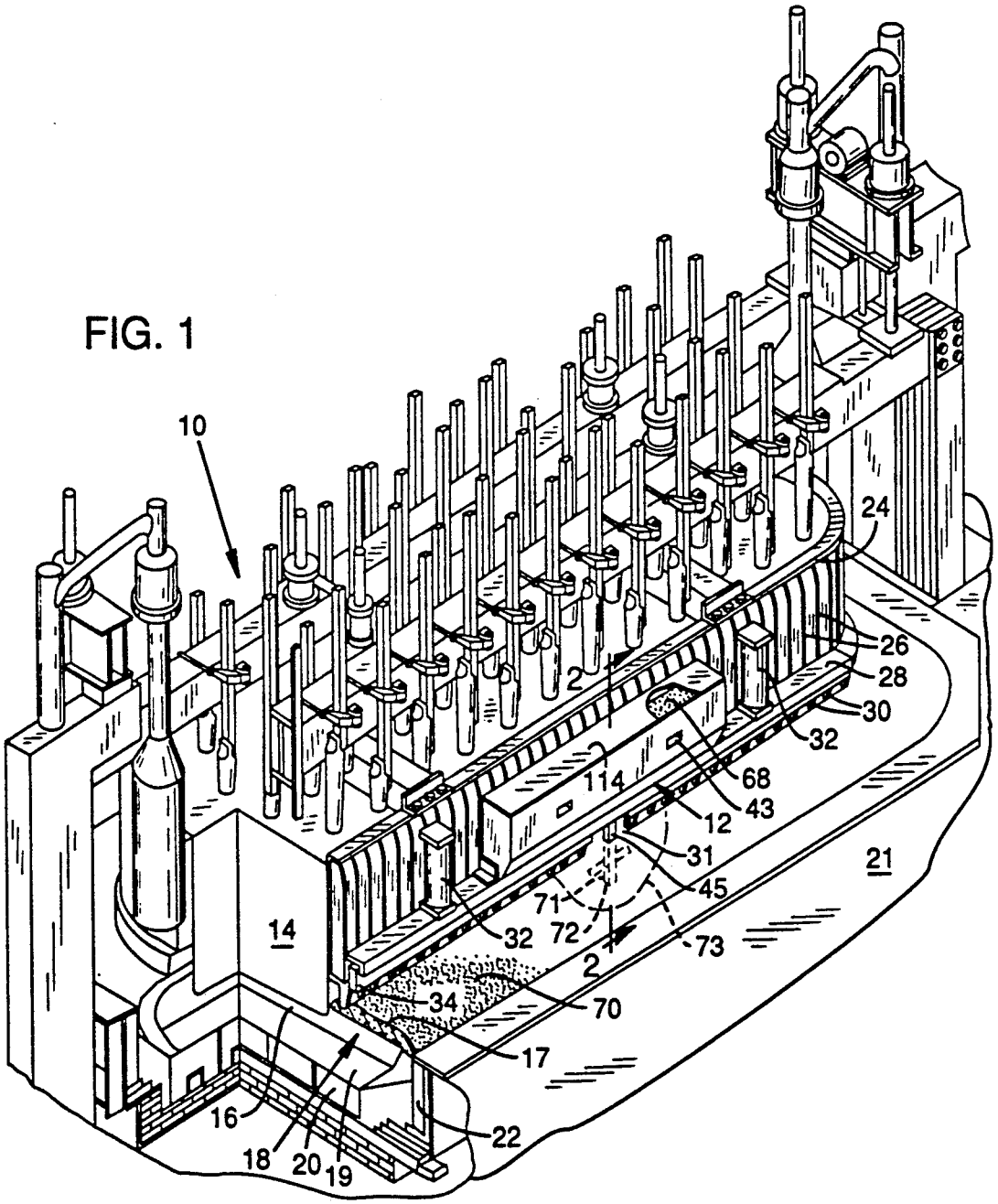
FIG. 1 is a perspective view of a Vertical Stud Soderberg aluminum reduction cell which has been retrofitted with a continuous point feeder assembly according to the present invention.

FIG. 1 shows a preferred embodiment of vertical-stud Soderberg alumina reduction cell 10 which has been retrofitted with a continuous point feeder assembly 12 according to the present invention. Soderberg cell 10 includes an anode 14 in contact with a molten electrolyte bath 16, which in operation is maintained at approximately 970° C. A solid electrolyte crust 17 forms over a peripheral region 18 of the electrolyte bath by cooling. Below molten electrolyte bath 16 is a pool of molten aluminum product 19 covering a cathode 20. Electrolyte bath 16 and molten aluminum product !9 are contained below floor level 21 within a refractory lined shell 22.

Anode 14 is contained within a generally rectangular anode jacket 24. A series of vertical fins 26 are attached to the outer surface of anode jacket 24. A horizontal beam 28 is welded along each side of anode jacket 24 for added rigidity. A gas collection skirt 30 extends along the bottom edge of anode jacket 24. A pair of breaker bar pneumatic cylinder assemblies 32 are mounted vertically near the ends of each beam 28. Each cylinder assembly 32 includes a piston rod 33 which extends through an opening 36 in the beam 28 to support a horizontal crust breaker bar 34 below each horizontal beam 28 (See FIG. 2). The crust breaker bar 34 extends generally along the underside of the beam 28 and is shown in a retracted position. One continuous point feeder assembly 12 per cell 10 is bolted into place on horizontal beam 28 over a slot 38 and a gas collection skirt recess 31 provided for that purpose.

Figure 2:
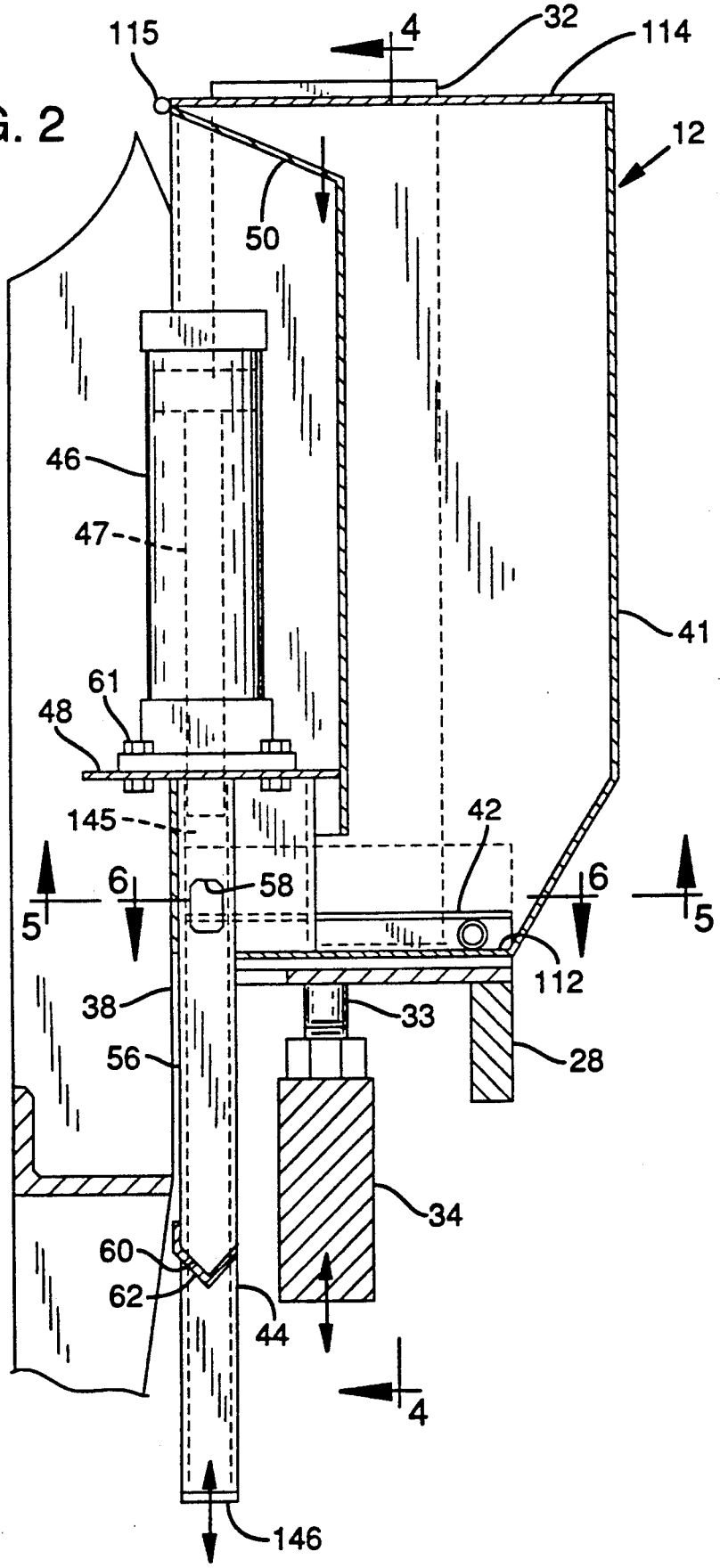
FIG. 2 is a side cross-sectional view of a central portion of the continuous point feeder.
Figure 3:
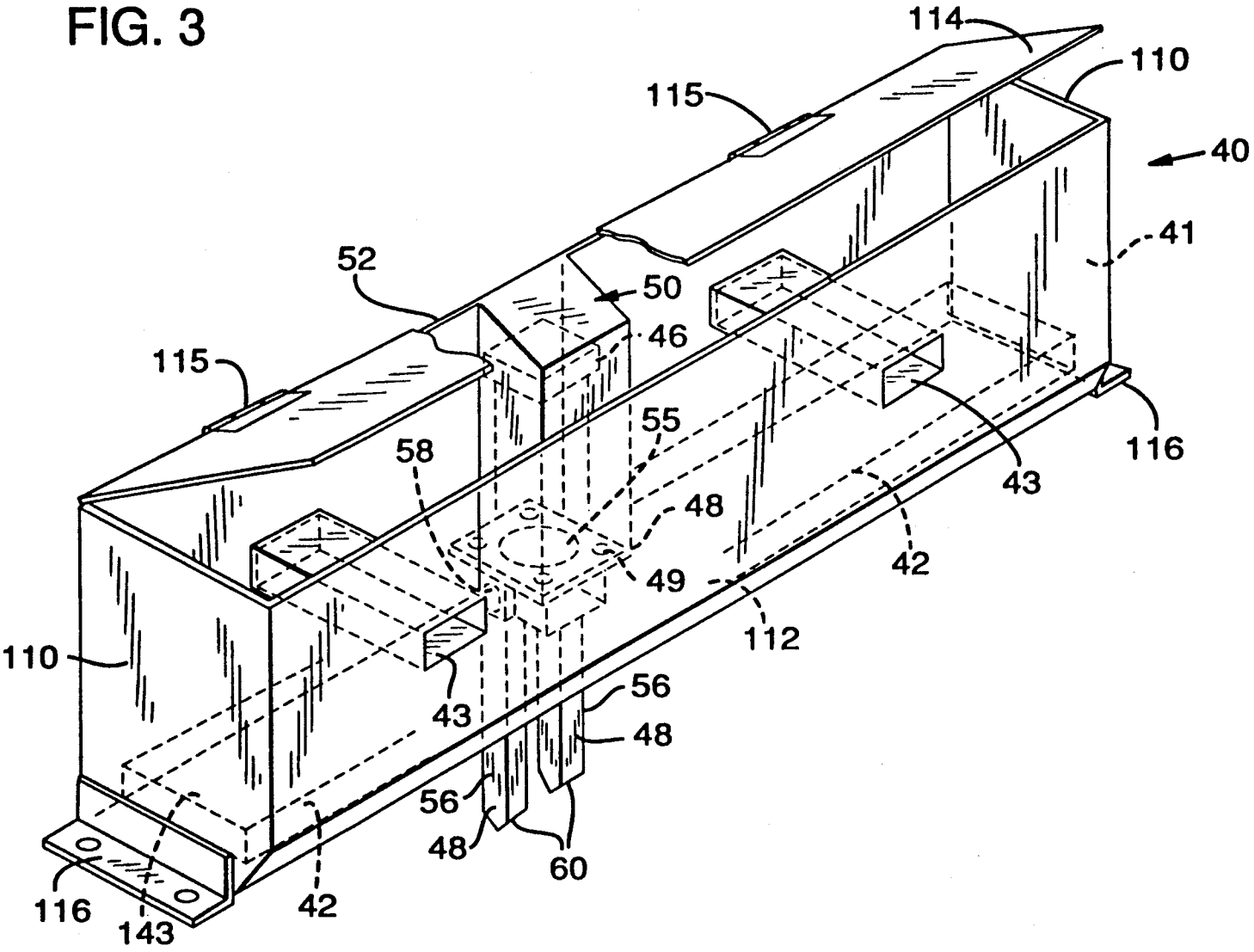
FIG. 3 is a perspective view of the feed hopper of the continuous point feeder assembly.
Figure 4:
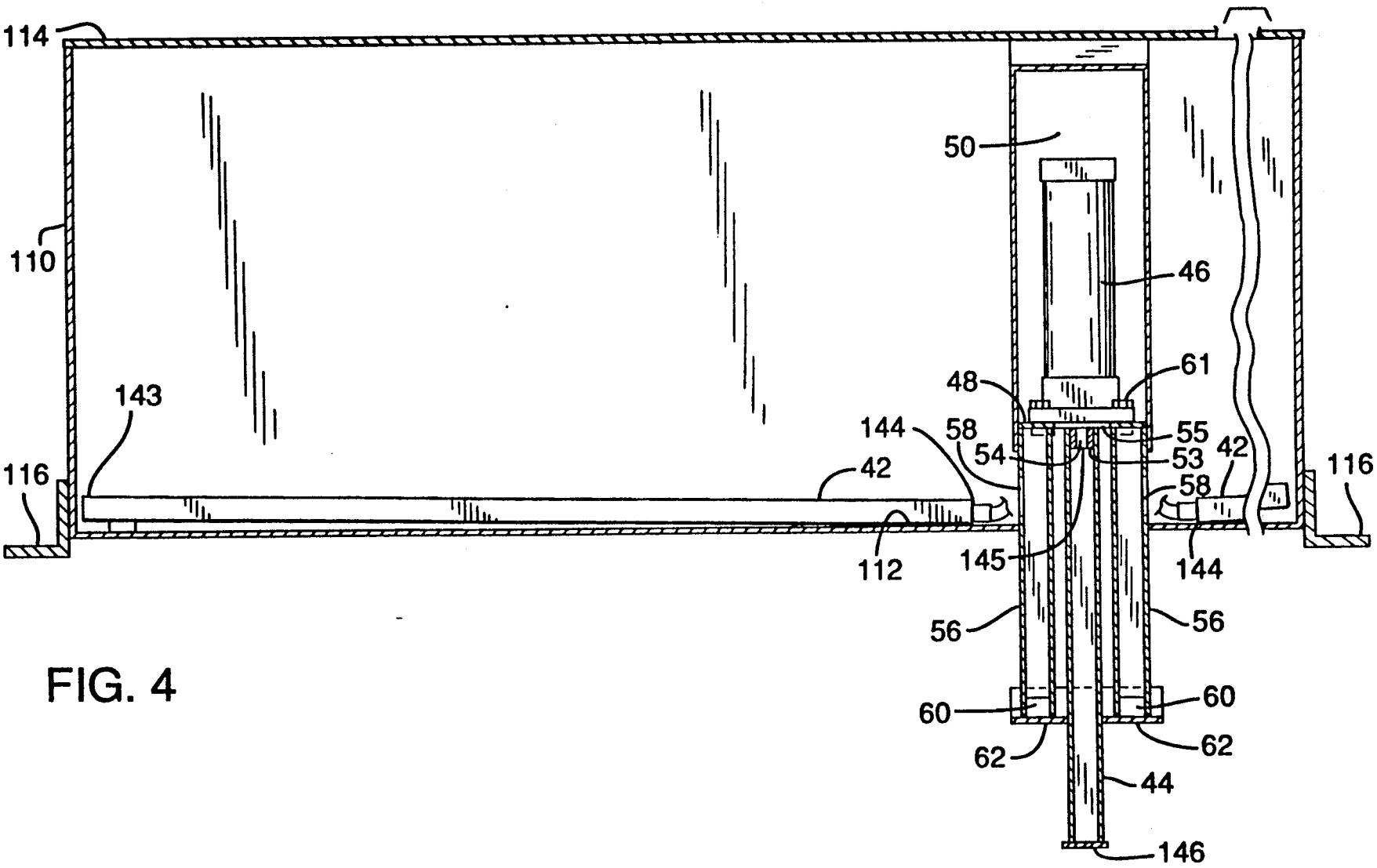
FIG. 4 is a rear cross-sectional fragmentary view of a central portion of the continuous point feeder.
Figure 5:
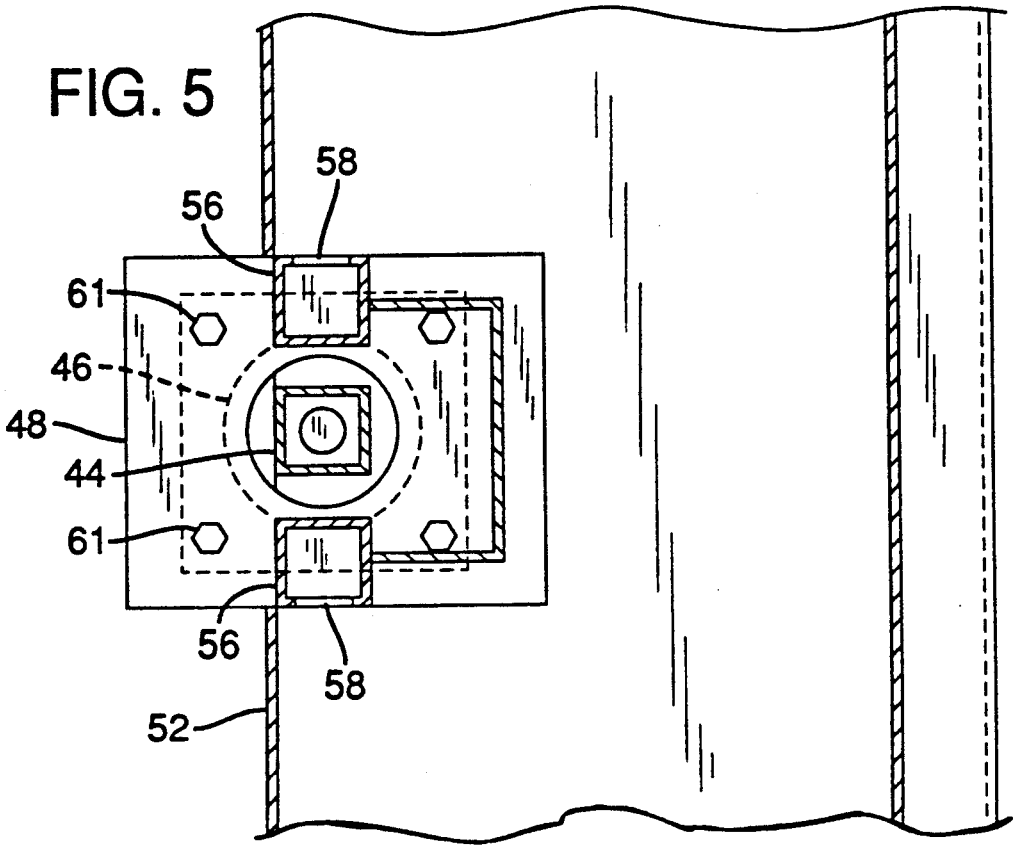
FIG. 5 is a top cross-sectional view of a central portion of the continuous point feeder.
Figure 6:
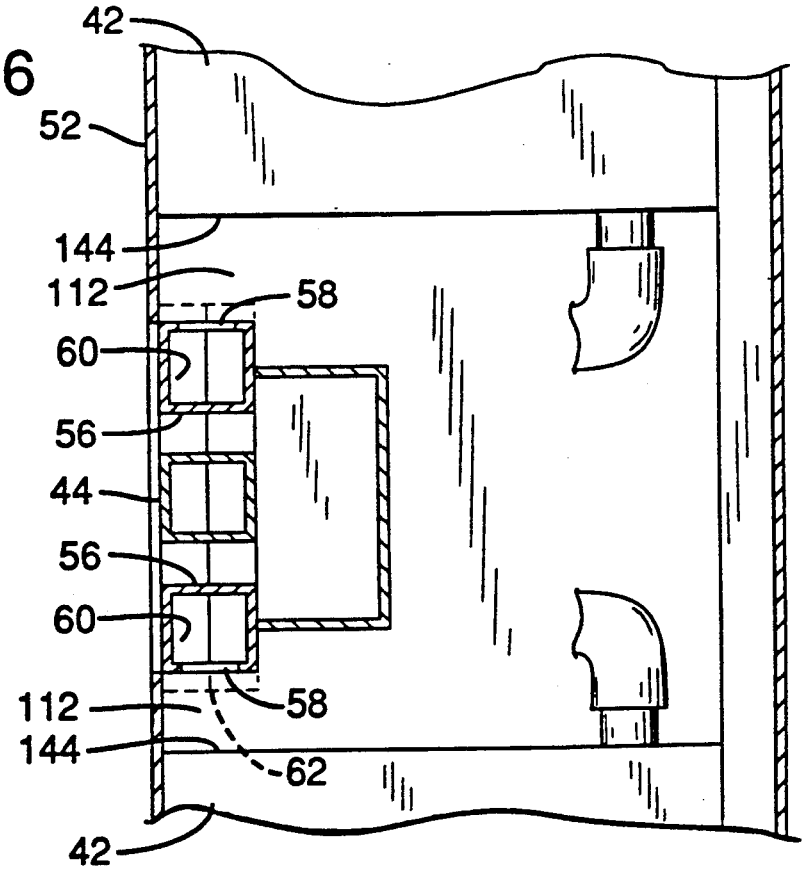
FIG. 6 is a bottom cross-sectional view of a central portion of the continuous point feeder.

Turning now to FIGS. 2–4, continuous point feeder assembly 12 includes a feed hopper 40 having a front wall 41, a rear wall 52, two side walls 110, a bottom wall 112. A top cover 114 is attached by hinges 115 to rear wall 52. Top cover 114 is opened to fill the feed hopper 40 with alumina feed 68 (FIG. 1). The bottom wall 112 rests on the horizontal beam 28, and extends outward to the edge of the horizontal beam 28. The lower portion of the front wall 41 is angled back to meet the bottom wall 112. A mounting bracket 116 is welded to each side wall 110 for securing the continuous point feeder 12 in place on the beam 28. Rectangular lifting slots 43 extend horizontally between the front wall 41 and the rear wall 52 for transporting the continuous point feeder 12 by forklift.

Rear wall 52 includes a rectangular recessed central portion that extends vertically through bottom wall 112. A horizontal support plate 48 is welded into the recess 50 above the bottom wall 112. Support plate 48 includes an aperture 55 and bolt holes 49. A pair of hollow, rectangular, elongate feeding bins 56 extend downward from the bottom of support plate 48, and terminate below feed hopper bottom 112. Each feeding bin 56 has a tapered, open bottom end which serves as a feed discharge port 60. Each feeding bin 56 also includes a generally rounded opening 58 into the feed hopper 40 which serves as a feed inlet port. The feed inlet ports 58 are located in feeding bin side walls 56 just above the feed hopper bottom wall 112, and provide a path for alumina feed 68 (FIG. 1) to flow from inside the feed hopper 40 into the feeding bins 56.

Inside the feed hopper 40, attached to bottom wall 112, are a pair of inclined air slide conveyors 42. The air slide conveyors 42 transport alumina feed material 68 within the feed hopper 40 toward the feeding bin inlet ports 58. Each air slide conveyor 42 has an elevated end 143 adjacent a feed hopper side wall 10, and a lower end 144 adjacent one feed inlet port 58. Air slide conveyors 42 are of conventional design.

A pneumatic piston and cylinder assembly 46 is mounted upright on the support plate 48. A suitable example is Atlas Cylinder, Model #Ref-1 Series A, commercially available. The piston and cylinder assembly is secured in place by nut and bolt assemblies 61 which pass through mounting holes and support plate bolt holes 49 (See FIG. 2). Attached to the piston (not shown) is a piston rod 47, which extends downward through aperture 55 in support plate 48, and which has external threads 54 formed on its lower end portion.

The piston rod 47 is attached at its lower end to a hollow, rectangular, elongate crust breaking member 44 located between the feeding bins 56. When the piston rod 47 is extended, crust breaking member 44 is driven downward through the solid crust 17 covering the peripheral region 18 of the molten bath 16. The crust breaking member 44 is made of steel, and includes a top portion 145 including an aperture having internal threads 53 which engage external threads 54 to attach crust breaking member 44 to piston rod 47. Crust breaking member 44 extends downward below the feeding bin discharge ports 60, and may include a plate 146 welded to the lower end of the crust breaking member 44. Alternatively, a solid circular shaft (not shown), preferably about 7 inches long, may be welded to the lower end. A pair of feed discharge port covers 62 extend horizontally from the crust breaking member 44. Each feed discharge port cover 62 is shaped to receive the tapered lower end of a respective one of the feeding bins 56. The discharge port cover is positioned to cover the corresponding feed discharge port 60 when crust breaking member 44 is in its retracted position, as best seen in FIG. 4.

Operation

In operation of Soderberg cell 10, molten electrolyte bath !6 initially contains a maximum desirable amount of dissolved alumina which is being reduced to aluminum product 19. As best seen in FIGS. 1-3, alumina feed material 68 is then continuously fed into the peripheral region 18 of molten bath 16 by the continuous point feeder assembly 12 as described next.

Alumina feed material 68 contained in feed hopper 40 is continuously conveyed toward the feed inlet ports 58 by the air slides 42. Alumina feed material 68 then flows by gravity through the feed inlet ports 58 and into the feeder bins 56. With the crust breaking member 44 in retracted position 45, the feed discharge ports 60 are sealed by the feed discharge port covers 62, causing the feeding bins 56 to fill with alumina feed material 68.

At frequent, predetermined intervals, a controller (not shown) activates the point feeder pneumatic cylinder assembly 46, driving the crust breaking member 44 downward within the gas collection skirt recess 31 to an extended position 71 (FIG. 1). The crust breaking member lower end is driven through the solid crust 17, forming an opening 73 in the solid crust 17. As the crust breaking member 44 is extended to position 71, the feed discharge port covers 62 uncover the feed discharge ports 60. Alumina feed material 68 then flows by gravity from the feeder bins 56 through the feed discharge ports 60, through the opening 73, and into the peripheral region 18 of the molten electrolyte bath 16. The pneumatic cylinder assembly 46 then raises the crust breaking member 44 to its retracted position 45. The feed discharge port covers 62 close the feed discharge ports 60, and the feeding bins 56 automatically refill with alumina feed material 68.

Alumina feed material 68 is continuously fed to the molten bath 16 in this manner at predetermined intervals. We have found it advantageous to do so at a rate less than the rate at which the reduction cell 10 is converting alumina feed material 68 into aluminum product 19. As a result, the amount of dissolved alumina in the molten electrolyte bath 16 eventually falls below the optimum minimum amount, leading to the onset of an anode effect.

In response to the onset of an anode effect, supplemental alumina feed material 70 is introduced into the molten bath 16 to restore the dissolved alumina content of the molten bath 16 to the maximum desired amount. In addition, substantially all of the solid crust 17 must be periodically broken and remelted in bath 16 to the prevent molten bath peripheral region 18 from freezing solid.

Referring again to FIG. 1, supplemental alumina feed material 70 is deposited on top of the solid crust 17. In order to prevent the peripheral region 18 from freezing solid, the breaker bar pneumatic cylinders 32 are periodically activated to drive the breaker bar 34 downward through the solid crust 17. The solid crust 17 collapses into the molten electrolyte bath 16 where it remelts. At the same time, supplemental alumina feed material 70 deposited on top of the solid crust 17 is forced into the peripheral region 18 of the molten bath 16. The supplemental alumina feed 70 dissolves in the molten bath 16, restoring the dissolved alumina content of the bath 16 to the desired maximum amount, and the solid crust 17 reforms.

In the preferred embodiment of the invention, the rate of continuous feeding of alumina feed material 68 by the continuous point feeder 12 is maintained to require supplemental alumina feed material 70 to be introduced only as often as the solid crust 17 must be broken to maintain the bath peripheral region 18 in a molten state. In this way, cell efficiency is maximized.

Working Example

A vertical-stud Soderberg cell was retrofitted with a continuous point feeder assembly according to the present invention, and operated continuously for a period of several weeks according to the method of the present invention. The bath contained 80-85% $NaAlF_4$, 5-8% $AlF_3$, and was maintained at approximately 970° C. Alumina feed material was fed continuously by the continuous point feeder at a rate of approximately 2 lbs at 330 second intervals. Supplemental alumina was fed into the cell at 6 hour intervals after breaking the frozen crust over the peripheral portion of the bath. Of the total alumina fed to the cell, 75-85% was continuously fed by the continuous point feeder, and 15-25% was fed by supplemental batch feeding. The cell efficiency was 89-93%.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A Vertical-Stud Soderberg type aluminum reduction cell for producing aluminum from alumina comprising:

a single anode having a bottom surface;

a molten electrolyte bath below the single anode, and having a molten top surface contacting the single anode bottom surface, the molten bath having a peripheral portion covered by a solid frozen crust;

a cathode below the molten electrolyte bath and in electrical contact therewith;

means for intermittently breaking substantially the entire solid frozen crust;

means for feeding a first amount of alumina into the molten bath after said solid frozen crust is broken and before the surface thereof freezes; and means for feeding a second amount of alumina through an opening in said solid frozen crust into the molten bath, after the surface of said molten bath freezes covering a peripheral side thereof, while leaving unbroken a substantial portion of the solid frozen crust.

2. The Vertical-Stud Soderberg aluminum reduction cell according to claim 1, wherein said means for feeding a first amount of alumina includes a point feeder assembly for introducing alumina through said solid frozen crust into said molten bath, said point feeder assembly comprising;

a feed hopper for storing alumina;

means for forming an opening in said solid frozen crust covering the molten bath; and means for feeding alumina from the feed hopper through the opening in the solid frozen crust into the molten bath.

3. A point feeder assembly according to claim 2, wherein the means for intermittently breaking substantially the entire solid frozen crust includes:

a rigid, elongated, crust breaking member movably disposed in a retracted position above the solid frozen crust; and means coupled to the crust-breaking member for moving the crust-breaking member downward and for driving a lower portion of the crust breaking member through the solid frozen crust, and then retracting the crust-breaking member to the retracted position, thereby forming the opening in the solid frozen crust for feeding the second amount of alumina into the molten bath.

4. A point feeder assembly according to claim 3, wherein the moving, driving and retracting means includes a pneumatic cylinder and piston assembly.

5. A point feeder assembly according to claim 3, wherein the crust breaking member driving and retracting means includes a pneumatic cylinder and piston assembly.

6. A point feeder assembly according to claim 2, which further includes:

a rigid, hollow elongate feeding bin for receiving alumina from the feed hopper;

means for transferring alumina from the feed hopper into the feeding bin; and means for discharging alumina from the feeding bin and into the molten bath.

7. A point feeder assembly according to claim 6, wherein the feeding bin includes:

an upper portion fixed to the feed hopper and a feeding bin inlet port which communicates with the interior of the hopper for receiving alumina; and a lower portion below the feed hopper so that the lower portion, in use, fills with alumina received through the feeding bin inlet port.

8. A point feeder assembly according to claim 6, wherein the alumina discharge means includes:

surfaces defining a discharge port in the feeder bin lower portion; and a discharge port cover fixed to the crust-breaking member, and disposed so that when the crust-breaking member is in the retracted position, the port cover sealingly engages the periphery of the feed discharge port to cover the port, thereby preventing the flow of alumina from the feeder bin and so that when the crust-breaking member driving means is operated to drive a portion of the crust breaking member downward through the solid frozen crust covering the molten bath, the port cover is disengaged from the periphery of the feeder discharge port to uncover the port, thereby allowing alumina to flow by gravity from the feeder bin through the feed discharge port, through the opening in the solid frozen crust, and into the molten bath.

9. A point feeder assembly according to claim 6, wherein the means for transferring alumina from the feed hopper to the feeding bin includes means within the feed hopper for transporting alumina to a location adjacent the feeder bin inlet port, from which location the alumina can flow by gravity through the feeder bin inlet port and into the feeder bin.

10. A point feeder assembly according to claim 9, wherein the alumina transporting means comprises an air slide conveyor.

11. A point feeder according to claim 6, including means for directing the discharged alumina into the opening in the solid frozen crust.

12. A Soderberg cell according to claim 1, which further includes an anode jacket having a lower edge, a gas collection skirt extending around the lower edge of the anode jacket, said means for continuously feeding a first amount of alumina disposed outside the gas collection skirt.

13. A method of feeding alumina to a single anode Vertical-Stud Soderberg type aluminum reduction cell for producing aluminum comprising the steps of:

forming a molten electrolytic bath having a peripheral portion covered by a solid frozen crust; forming an opening in the solid frozen crust;

feeding a first amount of alumina into the molten electrolyte bath through the opening leaving unbroken a substantial portion of the solid frozen crust covering the peripheral bath portion;

intermittently breaking substantially the entire solid frozen crust, and driving the crust covering the peripheral bath portion; and feeding a second amount of alumina into the molten bath after said frozen crust is broken.

14. A method of producing aluminum from alumina comprising the steps of:

providing a Vertical-Stud Soderberg type aluminum reduction cell having a cathode, a single anode, and a molten electrolyte bath containing dissolved alumina, the molten bath being an electrical contact with the cathode and the anode, and the molten bath having at least one peripheral side portion covered by a solid frozen crust, the reduction cell including at least one crust breaking assembly for periodically breaking substantially the entire solid frozen crust covering a peripheral side portion of the molten bath;

intermittently breaking substantially the entire solid frozen crust;

feeding a first amount of alumina into the molten bath after said solid frozen crust is broken and before the surface thereof freezes;

forming a solid frozen crust on at least one peripheral side of said molten bath;

forming an opening in a portion of the solid frozen crust leaving unbroken a substantial portion of the solid frozen crust;

feeding a second amount of alumina into the molten through the opening in said solid frozen crust; and passing an electrical current into the cell through the anode, through the molten electrolyte bath, and out of the cell through the cathode, thereby electrolytically reducing the dissolved alumina in the molten bath and forming aluminum.

15. A method according to claim 14, which further includes a means for feeding a second amount of alumina which comprises:

a feed hopper for storing alumina;

means for forming an opening in a solid frozen crust covering the molten bath through which alumina can be fed into the molten bath; and means for feeding alumina through the opening in the solid frozen crust into the molten bath.

16. A method according to claim 15, wherein the alumina feeding means includes:

a rigid, hollow elongate feeding means for receiving alumina from the feed hopper;

means for transferring alumina from the feed hopper into the rigid, hollow elongate means; and means for discharging alumina from the rigid, hollow elongate feeding means into the molten bath.

17. A method according to claim 16, wherein the rigid, hollow elongate feeding means includes:

an upper portion fixed to the feed hopper and an inlet port which communicates with the interior of the hopper for receiving alumina; and a lower portion below the feed hopper which in use fills with alumina received through the inlet port.

18. A method according to claim 16, which further includes an alumina discharge means comprising:

surfaces defining a discharge port in the lower portion; and a discharge port cover fixed to the crust-breaking member, and disposed so that when the crust-breaking member is in the retracted position, the port cover sealingly engages the periphery of the discharge port to cover the discharge port, thereby preventing the flow of alumina from the rigid, hollow elongate feeder means, and so that when the crust-breaking member driving means is operated to drive a portion of the crust breaking member downward through the solid frozen crust covering the molten bath, the port cover is disengaged from the periphery of the feeder discharge port to uncover the port, thereby allowing alumina to flow by gravity from the rigid, hollow engage feeder means through the feed discharge port, through the opening in the solid frozen crust, and into the molten bath.

19. A method according to claim 16, wherein the means for transferring alumina from the rigid, hollow elongate feeder means includes means within the feed hopper for transporting alumina to a location adjacent the inlet port, from which location the alumina can flow by gravity through the inlet port and into the rigid, hollow elongate feeder means.

20. A method according to claim 14, wherein the alumina transporting means comprises an air slide conveyor.

21. A according to claim 16, including means for directing the discharged alumina into the opening in the solid frozen crust.

22. A method according to claim 14, wherein the means for intermittently breaking substantially the entire solid frozen crust includes:

a rigid, elongated, crust breaking member movable disposed in a retracted position above the solid frozen crust; and means coupled to the crust-breaking member for moving the crust-breaking member downward and for driving a lower portion of the crust breaking member through the solid frozen crust, and then retracting the crust-breaking member to the retracted position, thereby forming the opening in the solid frozen crust for feeding the second amount of alumina into the molten bath.

23. A method according to claim 22, wherein the moving, driving and retracting means includes a pneumatic cylinder and piston assembly.

24. A method according to claim 22, wherein the crust breaking member driving and retracting means includes a hydraulic cylinder and piston assembly.

* * * * *

UNITED STATES PATENT AND TRADEMARK OFFICE

CERTIFICATE OF CORRECTION

PATENT NO. : 5,108,557

DATED : April 28, 1992

INVENTOR(S) : James H. Nordquist

It is certified that error appears in the above-identified patent and that said Letters Patent is hereby corrected as shown below:

| | | |
|---|---|---|
| On the Title page, item [57] Abstract | line 7 | change "as" to --an--; |
| Title page, item [57] Abstract | line 23 | change "curst" to --crust--; |
| Column 5 | line 57 | change "!9" to --19--; |
| Column 6 | line 45 | change "10," to --110,-- . |

Signed and Sealed this

Thirtieth Day of November, 1993

*Attest:*

*Attesting Officer*

BRUCE LEHMAN

*Commissioner of Patents and Trademarks*